US009913052B2

(12) United States Patent
Dzarnoski et al.

(10) Patent No.: US 9,913,052 B2
(45) Date of Patent: Mar. 6, 2018

(54) SOLDERLESS HEARING ASSISTANCE DEVICE ASSEMBLY AND METHOD

(71) Applicant: Starkey Laboratories, Inc., Eden Prairie, MN (US)

(72) Inventors: John Dzarnoski, Eden Prairie, MN (US); Susie Krzmarzick, Eden Prairie, MN (US); Douglas F. Link, Plymouth, MN (US); David Prchal, Hopkins, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/092,723

(22) Filed: Nov. 27, 2013

(65) Prior Publication Data

US 2015/0146899 A1 May 28, 2015

(51) Int. Cl.
*H04R 25/00* (2006.01)
*H04R 31/00* (2006.01)
(Continued)

(52) U.S. Cl.
CPC ..... *H04R 25/608* (2013.01); *H04R 25/658* (2013.01); *H04R 31/00* (2013.01);
(Continued)

(58) Field of Classification Search
CPC ..... H04R 25/00; H04R 25/608; H04R 31/00
See application file for complete search history.

(56) References Cited

U.S. PATENT DOCUMENTS 2,327,320 A 8/1943 Shapiro
2,424,422 A 7/1947 Tresise et al.
(Continued)

FOREIGN PATENT DOCUMENTS

DE 3006235 A1 10/1980
DE 3643124 A1 7/1988
(Continued)

OTHER PUBLICATIONS

Doug Gries, Photonics Applied: Microelectronics Processing: Laser Direct Structuring Crates Low-Cost 3D Intergated Circuits, Oct. 1, 2010, Laser Focus World, www.laserfocusworld.com.*
(Continued)

*Primary Examiner* — Fan Tsang
*Assistant Examiner* — Angelica M McKinney
(74) *Attorney, Agent, or Firm* — Schwegman Lundberg & Woessner, P.A.

(57) ABSTRACT

Disclosed herein, among other things, are systems and methods for solderless assembly for hearing assistance devices. One aspect of the present subject matter includes a method of manufacturing a hearing assistance device. According to various embodiments, the method includes providing a molded interconnect device (MID) housing and inserting a flexible circuit module having conductive surface traces into the MID housing. One or more hearing assistance electronic modules are connected to the MID housing using direct compression without the use of wires or solder, according to various embodiments. In one embodiment, the MID housing includes a laser-direct structuring (LDS) housing.

20 Claims, 7 Drawing Sheets

(51) Int. Cl.
*H01R 12/70* (2011.01)
*H01R 12/71* (2011.01)
*H01R 13/24* (2006.01)

(52) U.S. Cl.
CPC ..... *H01R 12/7076* (2013.01); *H01R 12/714* (2013.01); *H01R 13/2414* (2013.01); *H01R 2201/12* (2013.01); *H04R 2225/021* (2013.01); *H04R 2225/023* (2013.01); *H04R 2225/025* (2013.01); *Y10T 29/49005* (2015.01)

(56) References Cited

U.S. PATENT DOCUMENTS 3,728,509 A 4/1973 Shimojo
3,812,300 A 5/1974 Brander et al.
4,017,834 A 4/1977 Cuttill et al.
4,116,517 A 9/1978 Selvin et al.
4,310,213 A 1/1982 Fetterolf, Sr. et al.
4,564,955 A 1/1986 Birch et al.
4,571,464 A 2/1986 Segero
4,729,166 A 3/1988 Lee et al.
5,049,813 A * 9/1991 Van Loan ..... G01R 31/316 324/754.14
5,606,621 A 2/1997 Reiter et al.
5,687,242 A 11/1997 Iburg
5,708,720 A 1/1998 Meyer
5,755,743 A 5/1998 Volz et al.
5,802,183 A 9/1998 Scheller et al.
5,824,968 A 10/1998 Packard et al.
5,825,894 A 10/1998 Shennib
5,987,146 A 11/1999 Pluvinage et al.
6,031,923 A 2/2000 Gnecco et al.
6,167,138 A 12/2000 Shennib
6,456,720 B1 * 9/2002 Brimhall ..... H04R 25/60 381/322
6,766,030 B1 7/2004 Chojar
6,876,074 B2 4/2005 Kim
7,016,512 B1 3/2006 Feeley et al.
7,110,562 B1 9/2006 Feeley et al.
7,139,404 B2 11/2006 Feeley et al.
7,142,682 B2 11/2006 Mullenborn et al.
7,151,839 B2 12/2006 Niederdrank
7,256,747 B2 8/2007 Victorian et al.
7,260,233 B2 8/2007 Svendsen et al.
7,263,194 B2 8/2007 Niederdrank et al.
7,320,832 B2 1/2008 Palumbo et al.
7,354,354 B2 4/2008 Palumbo et al.
7,400,738 B2 7/2008 Niederdrank et al.
7,446,720 B2 11/2008 Victorian et al.
7,471,182 B2 12/2008 Kumano et al.
7,593,538 B2 9/2009 Polinske
7,777,681 B2 8/2010 Platz
7,971,337 B2 7/2011 Kral et al.
8,098,863 B2 1/2012 Ho et al.
8,254,608 B2 8/2012 De Finis et al.
8,295,517 B2 10/2012 Gottschalk et al.
8,385,573 B2 2/2013 Higgins
8,494,195 B2 7/2013 Higgins
8,605,913 B2 12/2013 Schwerdtner
8,638,965 B2 1/2014 Higgins et al.
8,705,785 B2 4/2014 Link et al.
2002/0131614 A1 9/2002 Jakob et al.
2003/0178247 A1 9/2003 Saltykov
2003/0200820 A1 10/2003 Takad et al.
2004/0010181 A1 1/2004 Feeley et al.
2004/0114776 A1 6/2004 Crawford et al.
2004/0120540 A1 * 6/2004 Mullenborn ..... H04R 19/005 381/322
2004/0240693 A1 12/2004 Rosenthal
2005/0008178 A1 1/2005 Joergensen et al.
2005/0111685 A1 5/2005 Gabathuler
2006/0097376 A1 5/2006 Leurs et al.
2006/0159298 A1 7/2006 Von Dombrowski et al.
2007/0009130 A1 1/2007 Feeley et al.
2007/0036374 A1 2/2007 Bauman et al.
2007/0121979 A1 5/2007 Zhu et al.
2007/0188289 A1 8/2007 Kumano et al.
2007/0248234 A1 10/2007 Ho et al.
2008/0003736 A1 1/2008 Arai et al.
2008/0026220 A9 1/2008 Bi et al.
2008/0160828 A1 7/2008 Dangelmaier et al.
2008/0187157 A1 8/2008 Higgins
2008/0199971 A1 8/2008 Tondra
2008/0260193 A1 10/2008 Westermann et al.
2009/0074218 A1 * 3/2009 Higgins ..... 381/323
2009/0075083 A1 3/2009 Bi et al.
2009/0196444 A1 8/2009 Solum
2009/0245558 A1 10/2009 Spaulding
2009/0262964 A1 10/2009 Havenith et al.
2010/0034410 A1 * 2/2010 Link ..... H04R 25/60 381/328
2010/0074461 A1 3/2010 Polinske
2010/0124346 A1 * 5/2010 Higgins ..... H04R 25/556 381/312
2010/0158291 A1 6/2010 Polinske et al.
2010/0158293 A1 6/2010 Polinske et al.
2010/0158295 A1 6/2010 Polinske et al.
2011/0051966 A1 * 3/2011 De Finis ..... H04R 25/65 381/322
2011/0261984 A1 * 10/2011 Reber ..... H04R 25/602 381/323
2012/0014549 A1 1/2012 Higgins et al.
2012/0263328 A1 10/2012 Higgins
2012/0268335 A1 10/2012 Zhang et al.
2012/0268348 A1 10/2012 Zhang et al.
2012/0303093 A1 * 11/2012 Wouters ..... A61N 1/36032 607/57
2013/0187594 A1 7/2013 Barth et al.
2013/0195294 A1 8/2013 Gebert et al.
2013/0230197 A1 9/2013 Higgins
2013/0328524 A1 12/2013 Bartulec et al.
2014/0153762 A1 * 6/2014 Shennib ..... H04R 25/656 381/329
2014/0194561 A1 * 7/2014 Ganguly ..... C08L 83/10 524/262
2015/0256952 A1 * 9/2015 Naumann ..... H04R 25/604 381/324

FOREIGN PATENT DOCUMENTS

DE 4005476 A1 7/1991
DE 9320391 U1 9/1993
DE 4233813 C1 11/1993
DE 29801567 U1 5/1998
EP 0339877 A3 11/1989
EP 0866637 A2 9/1998
EP 1065863 A2 1/2001
EP 1317163 A2 6/2003
EP 1465457 A2 10/2004
EP 1496530 A2 1/2005
EP 2257080 B1 3/2006
EP 1811808 A1 7/2007
EP 1816893 A1 8/2007
EP 2040343 A1 3/2009
EP 2063694 A1 5/2009
EP 2063694 A1 * 5/2009 ..... H01R 13/514
EP 2160047 A2 3/2010
EP 2200348 A1 6/2010
EP 2509341 A1 10/2012
EP 2160047 B1 10/2013
EP 2663097 A1 11/2013
EP 2879407 A1 6/2015
GB 1298089 11/1972
GB 1522549 8/1978
GB 1522549 B3 8/1978
JP 2209967 A 8/1990
JP 2288116 A 11/1990
JP 09199662 A 7/1997
WO WO-2004025990 A1 3/2004
WO WO-06094502 A1 9/2006
WO WO-2007148154 A1 12/2007
WO WO-2008092265 A1 8/2008
WO WO-2008097600 A1 8/2008

(56) References Cited

FOREIGN PATENT DOCUMENTS

| | | | |
|---|---|---|---|
| WO | WO-2008097600 | C1 | 8/2008 |
| WO | WO-2008116499 | A1 | 10/2008 |
| WO | WO-2011101041 | A1 | 8/2011 |
| WO | WO-2014064544 | A1 | 5/2014 |

OTHER PUBLICATIONS

Housden et al., Moulded Interconnect Devices, Feb. 2002, Prime Faraday Technology Watch, pp. 1-30.*
Doug Gries, Photonics Applied: Microelectronics Processing: Laser Direct Structuring creates Low-Cost 3D Integrated Circuits, Oct. 1, 201, Laser Focus World, www.laserfocusworld.com.*
Gries, Photonics Applied: Microelectronics Processing: Lasser direct structuring creates low-cost 3D interated circuits, Oct. 1, 2010, www.lasserfocusworld.com, pp. 1-8.*
"U.S. Appl. No. 11/857,439, Final Office Action dated Feb. 29, 2012", 16 pgs.
"U.S. Appl. No. 11/857,439, Non Final Office Action dated Aug. 17, 2011", 16 pgs.
"U.S. Appl. No. 11/857,439, Notice of Allowance dated May 30, 2012", 9 pgs.
"U.S. Appl. No. 11/857,439, Notice of Allowance dated Sep. 19, 2012", 9 pgs.
"U.S. Appl. No. 11/857,439, Response filed Apr. 30, 2012 to Final Office Action dated Feb. 29, 2012", 9 pgs.
"U.S. Appl. No. 11/857,439, Response filed Jun. 13, 2011 to Restriction Requirement dated May 11, 2011", 8 pgs.
"U.S. Appl. No. 11/857,439, Response filed Dec. 17, 2011 to Non Final Office Action dated Aug. 17, 2011", 12 pgs.
"U.S. Appl. No. 11/857,439, Restriction Requirement dated May 11, 2011", 6 pgs.
"U.S. Appl. No. 12/027,173, Final Office Action dated Dec. 8, 2011", 12 pgs.
"U.S. Appl. No. 12/027,173, Non Final Office Action dated Jul. 11, 2011", 10 pgs.
"U.S. Appl. No. 12/027,173, Non Final Office Action dated Jul. 27, 2012", 11 pgs.
"U.S. Appl. No. 12/027,173, Notice of Allowance dated Mar. 19, 2013", 8 pgs.
"U.S. Appl. No. 12/027,173, Response filed Jun. 8, 2012 to Final Office Action dated Dec. 8, 2011", 7 pgs.
"U.S. Appl. No. 12/027,173, Response filed Nov. 14, 2011 to Non Final Office Action dated Jul. 11, 2011", 8 pgs.
"U.S. Appl. No. 12/027,173, Response filed Dec. 26, 2012 to Non Final Office Action dated Jul. 27, 2012", 8 pgs.
"U.S. Appl. No. 12/539,195, Advisory Action dated Apr. 23, 2013", 3 pgs.
"U.S. Appl. No. 12/539,195, Final Office Action dated Feb. 11, 2013", 15 pgs.
"U.S. Appl. No. 12/539,195, Non Final Office Action dated Jul. 20, 2012", 13 pgs.
"U.S. Appl. No. 12/539,195, Non Final Office Action dated Aug. 2, 2013", 14 pgs.
"U.S. Appl. No. 12/539,195, Notice of Allowance dated Nov. 29, 2013", 12 pgs.
"U.S. Appl. No. 12/539,195, Response filed Apr. 11, 2013 to Final Office Action dated Feb. 11, 2013", 7 pgs.
"U.S. Appl. No. 12/539,195, Response filed Nov. 4, 2013 to Non Final Office Action dated Aug. 2, 2013", 7 pgs.
"U.S. Appl. No. 12/539,195, Response filed Dec. 20, 2012 to Non Final Office Action dated Jul. 20, 2012", 7 pgs.
"U.S. Appl. No. 12/548,051, Final Office Action dated Apr. 19, 2012", 12 pgs.
"U.S. Appl. No. 12/548,051, Non Final Office Action dated Jan. 24, 2013", 12 pgs.
"U.S. Appl. No. 12/548,051, Non Final Office Action dated Oct. 12, 2011", 11 pgs.
"U.S. Appl. No. 12/548,051, Notice of Allowance dated Jul. 31, 2013", 14 pgs.
"U.S. Appl. No. 12/548,051, Response filed Jan. 12, 2012 to Non Final Office Action dated Oct. 12, 2011", 9 pgs.
"U.S. Appl. No. 12/548,051, Response filed Apr. 24, 2013 to Non Final Office Action dated Jan. 24, 2013", 8 pgs.
"U.S. Appl. No. 12/548,051, Response filed Sep. 19, 2012 to Final Office Action dated Apr. 19, 2012", 8 pgs.
"U.S. Appl. No. 12/644,188, Advisory Action dated Jul. 25, 2013", 3 pgs.
"U.S. Appl. No. 12/644,188, Final Office Action dated May 22, 2013", 7 pgs.
"U.S. Appl. No. 12/644,188, Non Final Office Action dated Sep. 9, 2013", 9 pgs.
"U.S. Appl. No. 12/644,188, Non Final Office Action dated Sep. 19, 2012", 8 pgs.
"U.S. Appl. No. 12/644,188, Response filed Feb. 19, 2013 to Non Final Office Action dated Sep. 19, 2012", 6 pgs.
"U.S. Appl. No. 12/644,188, Response filed Jul. 22, 2013 to Final Office Action dated May 22, 2013", 6 pgs.
"U.S. Appl. No. 12/644,188, Response filed Dec. 9, 2013 to Non Final Office Action dated Sep. 9, 2013", 6 pgs.
"U.S. Appl. No. 13/181,752, Final Office Action dated Jul. 11, 2013", 7 pgs.
"U.S. Appl. No. 13/181,752, Non Final Office Action dated Mar. 5, 2013", 7 pgs.
"U.S. Appl. No. 13/181,752, Notice of Allowance dated Sep. 25, 2013", 9 pgs.
"U.S. Appl. No. 13/181,752, Response filed Jun. 5, 2013 to Non Final Office Action dated Mar. 5, 2013", 8 pgs.
"U.S. Appl. No. 13/181,752, Response filed Sep. 11, 2013 to Final Office Action dated Jul. 11, 2013", 8 pgs.
"U.S. Appl. No. 13/422,177, Final Office Action dated Feb. 27, 2014", 12 pgs.
"U.S. Appl. No. 13/422,177, Non Final Office Action dated Sep. 26, 2013", 10 pgs.
"U.S. Appl. No. 13/422,177, Response filed Dec. 20, 2013 to Non Final Office Action dated Sep. 26, 2013", 8 pgs.
"U.S. Appl. No. 13/776,557, Non Final Office Action dated Oct. 22, 2013", 6 pgs.
"U.S. Appl. No. 13/776,557, Response filed Jan. 22, 2014 to Non Final Office Action dated Oct. 22, 2013", 6 pgs.
"European Application Serial No. 12167845.2, Extended EP Search Report mailed Sep. 12, 2012", 6 pgs.
"European Application Serial No. 08253065.0, European Examination Notification mailed Oct. 11, 2011", 7 pgs.
"European Application Serial No. 08253065.0, European Office Action dated Aug. 26, 2010", 6 Pgs.
"European Application Serial No. 08253065.0, Extended Search Report dated Dec. 15, 2008", 9 pgs.
"European Application Serial No. 08253065.0, Office Action dated Jul. 17, 2009", 1 pg.
"European Application Serial No. 08253065.0, Response filed Jan. 26, 2010 to Office Action dated Jul. 17, 2009", 9 pgs.
"European Application Serial No. 08253065.0, Response filed Feb. 8, 2012 to Examination Notification dated Oct. 11, 2011", 15 pgs.
"European Application Serial No. 08253065.0, Response to Office Action filed Feb. 28, 2011 to European Office Action dated Aug. 26, 2010", 17 pgs.
"European Application Serial No. 08725262.3, EPO Written Decision to Refuse dated Oct. 19, 2012", 14 pgs.
"European Application Serial No. 08725262.3, Office Action dated Apr. 21, 2010", 6 Pgs.
"European Application Serial No. 08725262.3, Office Action dated Aug. 5, 2011", 5 pgs.
"European Application Serial No. 08725262.3, Response filed Feb. 13, 2012 to Office Action dated Aug. 5, 2011", 11 pgs.
"European Application Serial No. 08725262.3, Response Filed Nov. 2, 2010 to Office Action dated Apr. 21, 201", 14 pgs.
"European Application Serial No. 08725262.3, Summons to Attend Oral Proceedings dated Jun. 6, 2012", 5 pgs.
"European Application Serial No. 09168844.0, European Search Report dated Apr. 19, 2010", 3 Pgs.

(56) References Cited

OTHER PUBLICATIONS

"European Application Serial No. 09168844.0, Office Action dated Apr. 8, 2013", 5 pgs.
"European Application Serial No. 09168844.0, Office Action dated Apr. 28, 2011", 5 pgs.
"European Application Serial No. 09168844.0, Office Action dated May 14, 2012", 2 pgs.
"European Application Serial No. 09168844.0, Office Action dated May 3, 2010", 5 pgs.
"European Application Serial No. 09168844.0, Response filed Feb. 24, 2012 to Office Action dated Apr. 28, 2011", 12 pgs.
"European Application Serial No. 09168844.0, Response filed Jul. 24, 2012 to Examination Notification Art. 94(3) dated May 14, 2012", 10 pgs.
"European Application Serial No. 09168844.0, Response Filed Nov. 15, 2010 to Office Action dated May 3, 2010", 8 pgs.
"European Application Serial No. 09250729.2, Extended Search Report dated Dec. 14, 2009", 4 pgs.
"European Application Serial No. 12167845.2, Response filed Apr. 10, 2013 to Extended European Search Report dated Sep. 12, 2012", 14 pgs.
"European Application Serial No. 09168844.0, Office Action dated Sep. 4, 2012", 4 pgs.
"European Application Serial No. 09168844.0, Response filed Mar. 14, 2013 to Office Action dated Sep. 4, 2012", 34 pgs.
"International Application Serial No. PCT/US2008/001609, International Preliminary Report on Patentability mailed Aug. 20, 2009", 10 pgs.
"International Application Serial No. PCT/US2008/001609, Search Report dated Jun. 19, 2008", 7 pgs.
"International Application Serial No. PCT/US2008/001609, Written Opinion dated Jun. 19, 2008", 8 pgs.
"LPKF Laser & Electronics", [Online]. Retrieved from the Internet: <URL: http://www.lpkf.com/__mediafiles/1276-three-dimensional-pcb-for-hearing-aid.pdf., (Accessed Mar. 18, 2015), 1 pg.
"R+D Microson Audiological Research", [Online]. Retrieved from the Internet: <URL: http://www.microson.es/Profesionales/IDMicroson/TecnologiaMIDENG.aspx, (Accessed Apr. 30, 2013), 1 pg.
Buchoff, L S, "Advanced Non-Soldering Interconnection", Electro International, 1991 (IEEE), XP 10305250A1, (1991), 248-251.
Tondra, Mark, "Flow Assay With Integrated Detector", U.S. Appl. No. 60/887,609, filed Feb. 1, 2007, 28 pgs.
"European Application Serial No. 14194666.5, Extended European Search Report dated Apr. 17, 2015", 9 pgs.
"European Application Serial No. 14194666.5, Response filed Dec. 8, 2015 to Extended European Search Report dated Apr. 17, 2015", 17 pgs.
"U.S. Appl. No. 14/692,849, Non Final Office Action dated Jul. 29, 2016", 18 pgs.
"U.S. Appl. No. 14/692,849, Response filed Oct. 31, 2016 to Non Final Office Action dated Jul. 29, 2016", 8 pgs.
"European Application Serial No. 16166704.3, Extended European Search Report dated Jul. 29, 2016", 11 pgs.
"Molded interconnect device—Wikipedia, the free encyclopedia", XP055290225, [Online] retrieved from the internet: <https://enwikipedia.org/w/index.php?title=Molded_interconnect_device&oldid=646412742>, (Feb. 9, 2015), 3 pgs.
MacLeod, Peter et al., "A Review of Flexible Circuit Technology and its Applications", PRIME Faraday Technology Watch, (2002), 1-59.
"European Application U.S. Appl. No. 14194666.5, Office Action mailed 06-14-17", 5 pgs.
"European Application U.S. Appl. No. 16166704.3, Response filed 08-16-17 to Extended European Search Report mailed 07-29-16", 10pgs.
"Application U.S. Appl. No. 14/692,849, Final Office Action mailed 02-01-17", 18 pgs.
"Application U.S. Appl. No. 14/692,849, Response Filed 04/03/17 to Final Office Action mailed 02-01-17", 9 pgs.
/Angelica M Mckinney/ Date C Ons Idered Oct. 18, 2017.
"U.S. Appl. No. 14/692,849, Notice of Allowability dated Nov. 2, 2017", 2 pgs.
"U.S. Appl. No. 14/692,849, Notice of Allowance dated Oct. 17, 2017", 11 pgs.
"European Application Serial No. 14194666.5, Response filed Nov. 30, 2017 to Office Action dated Jun. 14, 2017", 8 pgs.

* cited by examiner

SOLDERLESS HEARING ASSISTANCE DEVICE ASSEMBLY AND METHOD

TECHNICAL FIELD

This document relates generally to hearing assistance systems and more particularly to methods and apparatus for solderless assembly for hearing assistance devices.

BACKGROUND

Hearing assistance devices, such as hearing aids, include, but are not limited to, devices for use in the ear, in the ear canal, completely in the canal, and behind the ear. Such devices have been developed to ameliorate the effects of hearing losses in individuals. Hearing deficiencies can range from deafness to hearing losses where the individual has impairment responding to different frequencies of sound or to being able to differentiate sounds occurring simultaneously.

The hearing aid in its most elementary form usually provides for auditory correction through the amplification and filtering of sound. Hearing aids typically include an enclosure or housing, a microphone, hearing assistance device electronics including processing electronics, and a speaker or receiver. Existing hearing aid circuits and bodies are hand assembled, use individual wires for interconnects, and use a messy and time-consuming soldering process.

Accordingly, there is a need in the art for methods and apparatus for improved assembly for hearing assistance devices.

SUMMARY

Disclosed herein, among other things, are systems and methods for solderless assembly for hearing assistance devices. One aspect of the present subject matter includes a method of manufacturing a hearing assistance device. According to various embodiments, the method includes providing a molded interconnect device (MID) housing, such as a laser-direct structuring (LDS) housing, and inserting a flexible circuit module having conductive surface traces into the MID housing. One or more hearing assistance electronic modules are connected to the MID housing using direct compression without the use of wires or solder, according to various embodiments.

One aspect of the present subject matter includes a hearing assistance device. According to various embodiments, the hearing assistance device includes a MID housing and a flexible circuit module having conductive surface traces, the flexible circuit module configured to be inserted into the MID housing. One or more hearing assistance electronic modules are configured to connect to the MID housing using direct compression without the use of wires or solder, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense. Hearing aids typically include an enclosure or housing, a microphone, hearing assistance device electronics including processing electronics, and a speaker or receiver. Existing hearing aid circuits and bodies are hand assembled, use individual wires for interconnects, and use a messy and time-consuming soldering process.

Disclosed herein, among other things, are systems and methods for solderless assembly for hearing assistance devices. One aspect of the present subject matter includes a hearing assistance device. According to various embodiments, the hearing assistance device includes a MID housing, such as a LDS housing and a flexible circuit module having conductive surface traces, the flexible circuit module configured to be inserted into the MID housing. One or more hearing assistance electronic modules are configured to connect to the flexible circuit module using direct compression without the use of wires or solder, in various embodiments. The present subject matter uses molded interconnect device (MID) technology that combines injection-molded thermoplastic parts with integrated electronic circuit traces using selective metallization. One type of MID technology is LDS. In LDS, thermoplastic parts are doped with a metal-plastic additive that can be activated using a laser. The present subject matter contemplates any and all types of MID technology for implementation of the solderless hearing assistance device system.

Figure 1:
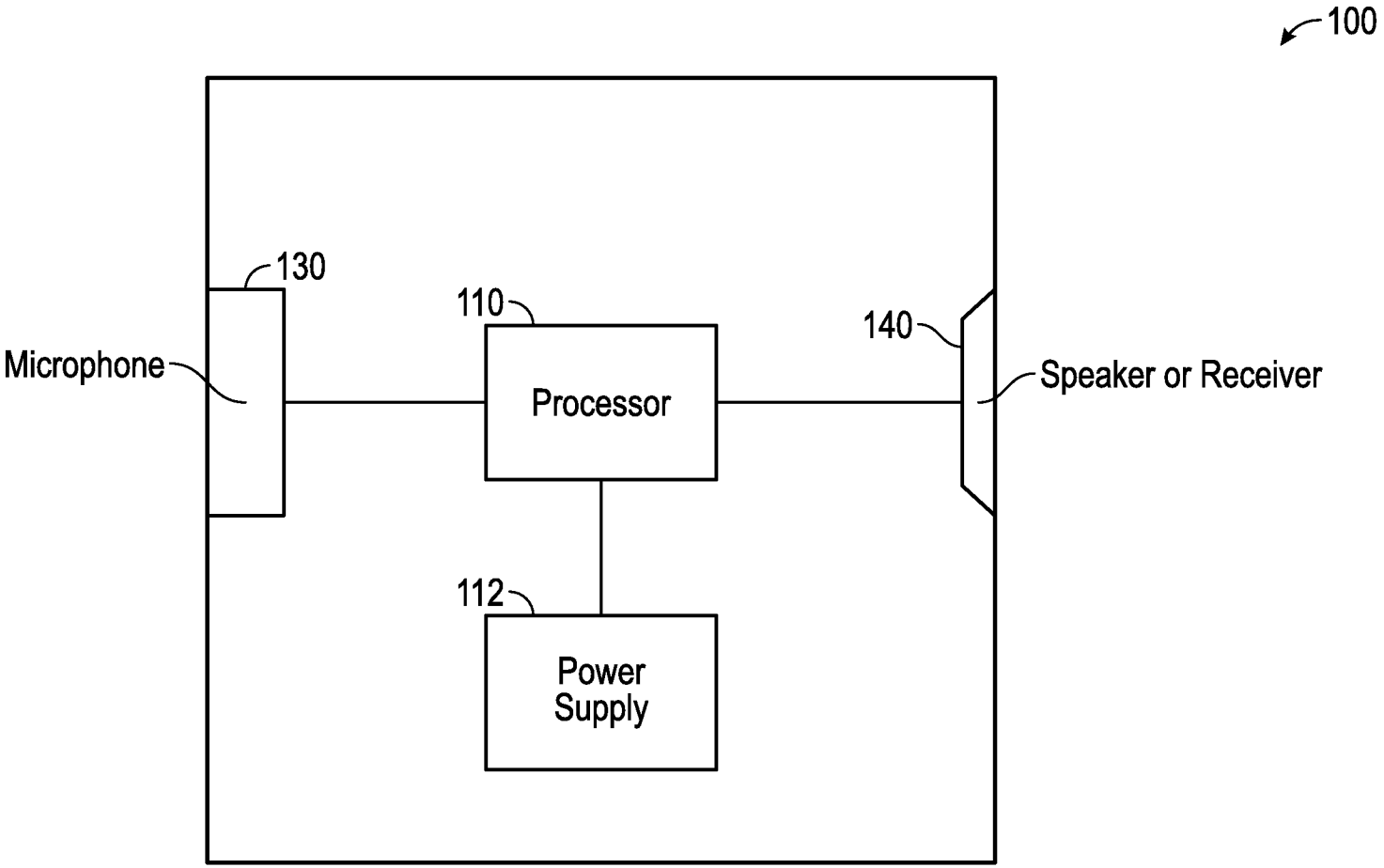
FIG. 1 shows a block diagram of a hearing assistance device, according to various embodiments of the present subject matter.

FIG. 1 shows a block diagram of a hearing assistance device 100 according to one embodiment of the present subject matter. In this exemplary embodiment the hearing assistance device 100 includes hearing assistance electronics such as a processor 110 and at least one power supply 112. In one embodiment, the processor 110 is a digital signal processor (DSP). In one embodiment, the processor 110 is a microprocessor. In one embodiment, the processor 110 is a microcontroller. In one embodiment, the processor 110 is a combination of components. It is understood that in various embodiments, the processor 110 can be realized in a configuration of hardware or firmware, or a combination of both. In various embodiments, the processor 110 is programmed to provide different processing functions depending on the signals sensed from the microphone 130. In hearing aid embodiments, microphone 130 is configured to provide signals to the processor 110 which are processed and played to the wearer with speaker 140 (also known as a "receiver" in the hearing aid art).

Other inputs may be used in combination with the microphone. For example, signals from a number of different signal sources can be detected using the teachings provided herein, such as audio information from a FM radio receiver, signals from a BLUETOOTH or other wireless receiver, signals from a magnetic induction source, signals from a wired audio connection, signals from a cellular phone, or signals from any other signal source.

The present subject matter overcomes several problems encountered in assembling hearing assistance devices and their subcomponents. One of these problems is the time consuming, messy process of hand assembly and soldering. Another problem overcome by the present subject matter is the lengthy design time of each hearing aid circuit. Finally, the overall cost of materials, such as high density flex, is reduced by the present subject matter.

Currently, the assembly of flexible circuits into hearing aids can be complicated. Once the flexible circuit is inserted into the spine, each limb of the circuit must be bent down and connected to another component. The connection is currently made by direct soldering, such as to a battery contact, or a wire must be soldered to the flexible circuit pad and then run to a second component, such as a push button or microphone. Currently the primary method of soldering wire connections is hand soldering, and this process alone contributes significantly to the time required to make a custom hearing assistance product. In addition, the use of heat in the soldering process can cause component and circuit damage both during assembly and repair. Thus, the current method of using wires and soldering for hearing assistance device component interconnects consumes labor, time, additional parts (wires and additional subassemblies), additional parts cost, additional connection points and increased system volume. It also provides a difficult and messy repair process. Furthermore, the wires must be placed over the spine, taking up valuable space, and can be pulled or broken during the process.

Previous solutions to the hand soldering and assembly steps include attempts to reduce the number of wires necessary in standard hearing aid designs, specifically by replacing them with additional flexible circuit limbs. The addition of more limbs leads to even more complex and abstractly shaped circuits. This leads to fewer circuits per panel and consequently a larger numbers of costly circuit panels. The past solutions to reduce the time and effort related to designing flexible circuits have focused on designing a common flexible circuit board between products. A common flexible circuit board is difficult to accomplish due to the diverse hearing aid design shapes, electrical requirements and location of connection points. Previously, when a common design has been successfully developed it has required the removal of a circuit limb for each hearing aid design. This results in wasted flexible circuit material as well as wasted space per panel. There are also efforts made to redesign current product flexible circuit designs in order to fit more circuits per panel. These attempts result in only a few more circuits fitting onto the panel and the cost savings is minimal. This also results in even more circuit design time spent per hearing aid design.

The present subject matter provides a hearing aid circuit and body that can be assembled without the need for solder or conductive epoxy. The present subject matter is unique in that it provides a method of assembling a hearing aid circuit to the spine and other components without the need of solder or conductive epoxy by utilizing a high density flexible circuit without wires in combination with a low density MID spine or housing, in various embodiments. Various embodiments of the present subject matter include a solderless microphone connection, solderless DSP module connection, solderless integration of a receiver jack, and solderless integrated programming interface. The present subject matter improves upon previous solutions because it does not require the addition of more wires or flexible circuit limbs. In various embodiments, the method of the present subject matter leads to higher yields of hearing aid components since they are not subjected to soldering temperatures. Additionally, the design time and effort associated with developing new hearing aids is reduced, making assembly and repair substantially easier and quicker, and eliminating the need for circuit limbs leading to more circuits per panel.

According to various embodiments, the present subject matter includes four types of solderless assembly connection. The connections are made via direct compression where the MID conductors form a connection with the flex without intermediary materials such as solder or conductive epoxy. The drawings illustrate a custom hearing aid application, but one of skill in the art would understand that the present subject matter is equally applicable to other types of hearing aids, such as those with a standard spine.

Figure 2A:
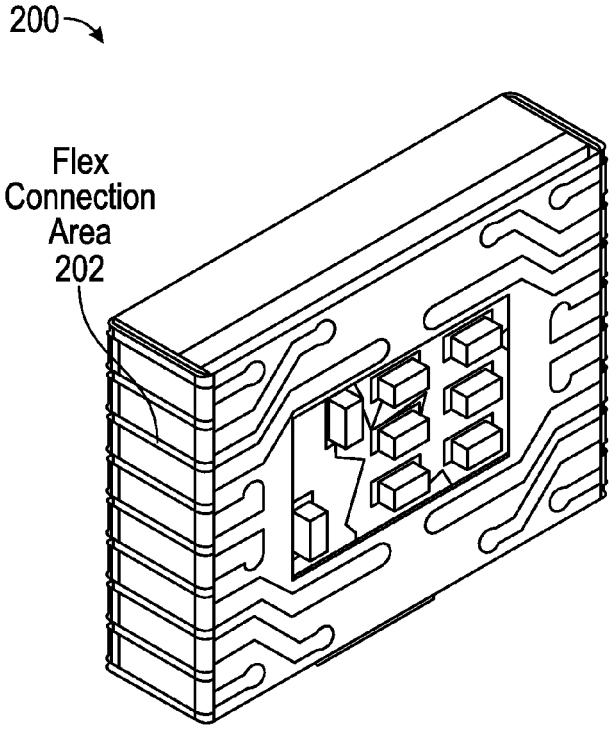
FIGS. 2A-2B illustrate views of a flexible circuit module for a hearing assistance device, according to various embodiments of the present subject matter.
Figure 2B:
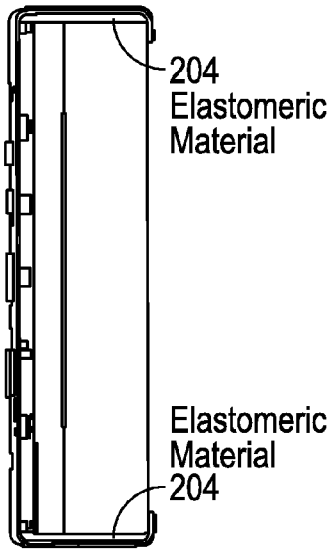

FIGS. 2A-2B illustrate views of a flexible circuit module for a hearing assistance device, according to various embodiments of the present subject matter. A DSP module 200 includes an integrated flex connection area 202 having exposed traces. The exposed traces include Nickel Gold plating, in an embodiment. Other types of traces can be used without departing from the scope of the present subject matter. The traces are locate on the edges of the module, in various embodiments. An elastomeric material 204 is located between the flex and the module sides in various embodiments, providing pressure to ensure proper connections.

Figure 3A:
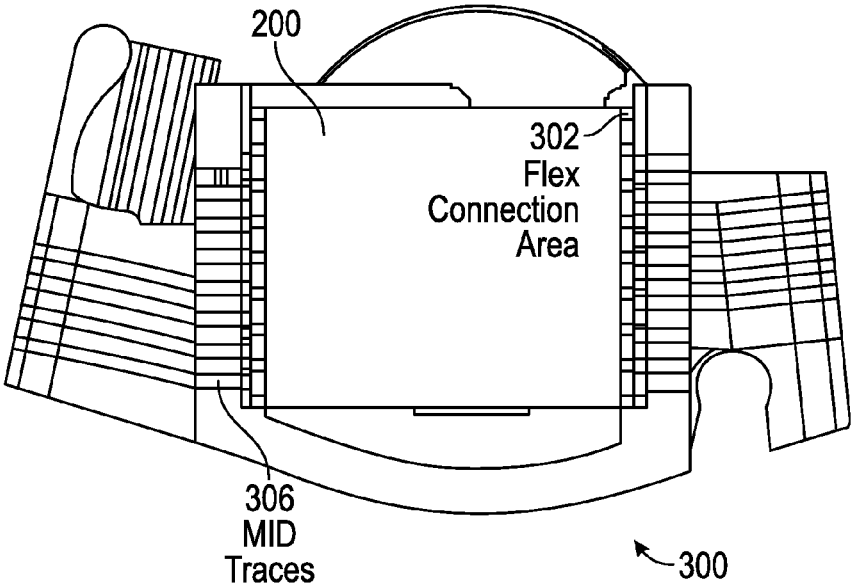
FIGS. 3A-3C illustrate views of a MID housing including conductive surface traces for a hearing assistance device, according to various embodiments of the present subject matter.
Figure 3B:
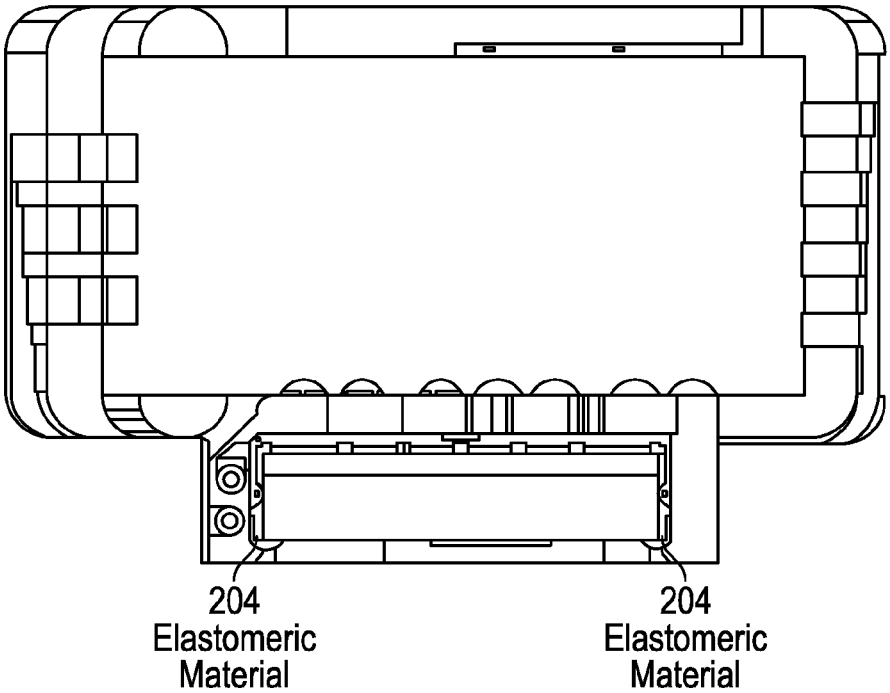
Figure 3C:
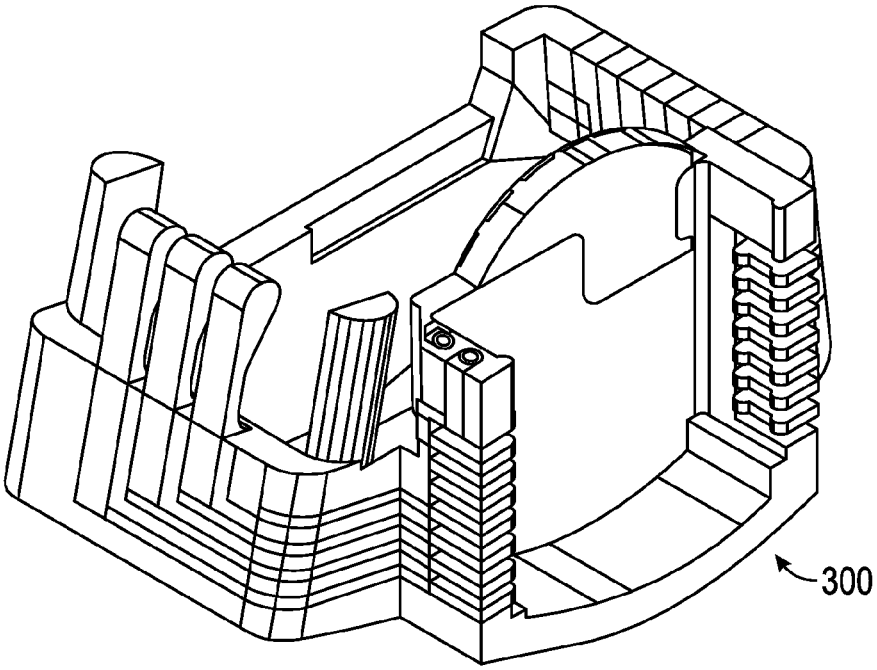

FIGS. 3A-3C illustrate views of a MID housing 300 including conductive surface traces for a hearing assistance device, according to various embodiments of the present subject matter. The electrical connection with the flex connection area 302 is made with plastic fingers with traces 306 that have been processed using LDS or other three-dimensional (3D) molded interconnect device (MID) technologies to provide both the connection point as well as interconnection to other components, according to various embodiments. The elastomeric material 204 located between the flex and the module sides provides pressure to ensure proper connections, in various embodiments.

Figure 4:
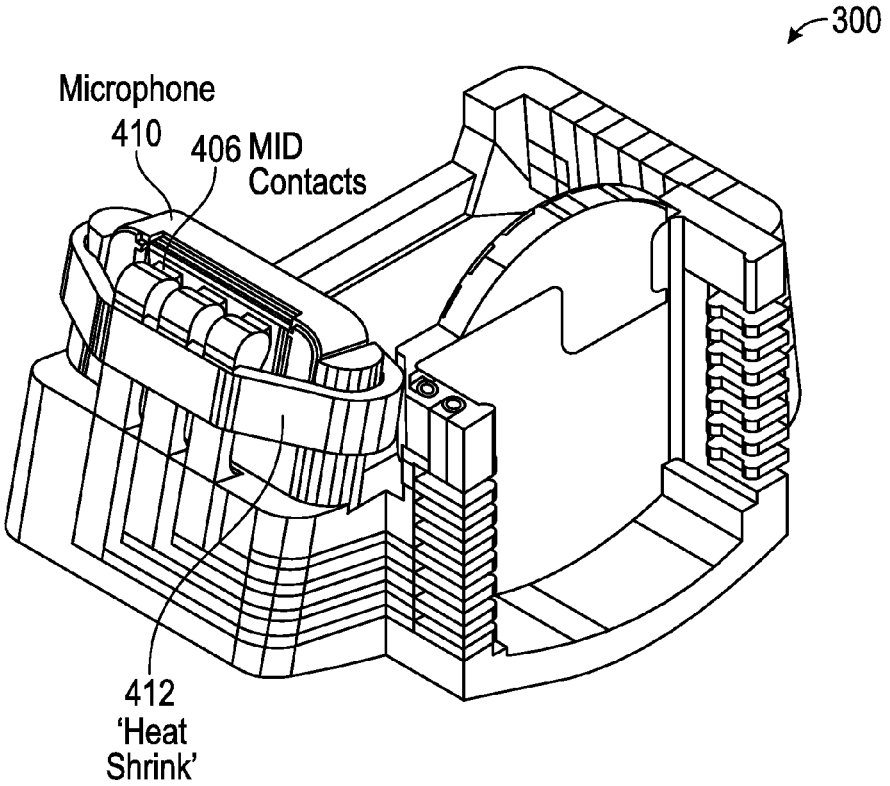
FIGS. 4-5 illustrate views of a MID housing including a microphone connection for a hearing assistance device, according to various embodiments of the present subject matter.
Figure 5:
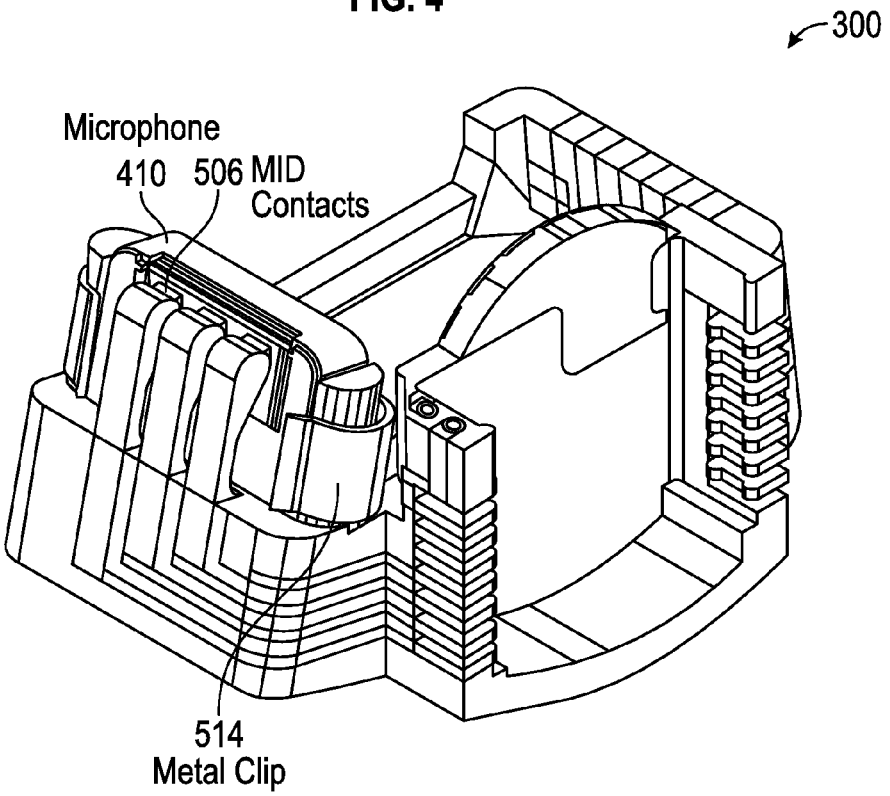

FIGS. 4-5 illustrate views of a MID housing 300 including a microphone connection for a hearing assistance device, according to various embodiments of the present subject matter. In various embodiments, a connection to a microphone 410 is made directly to the microphone pads. An LDS or other 3D MID technology is used to create metallized contacts 406 that can also function as interconnects to other components, in various embodiments. According to various embodiments, the contacts 406 are integral to the polymer contact fingers which provide one side of the connection. A retention band 412 of irradiated polymer (heat shrink) is applied over the microphone and fingers and heat applied to provide compression, in an embodiment. In another embodiment, the retention is provided using a metal clip 514. Other retention mechanisms are possible without departing from the scope of the present subject matter.

Figure 6:
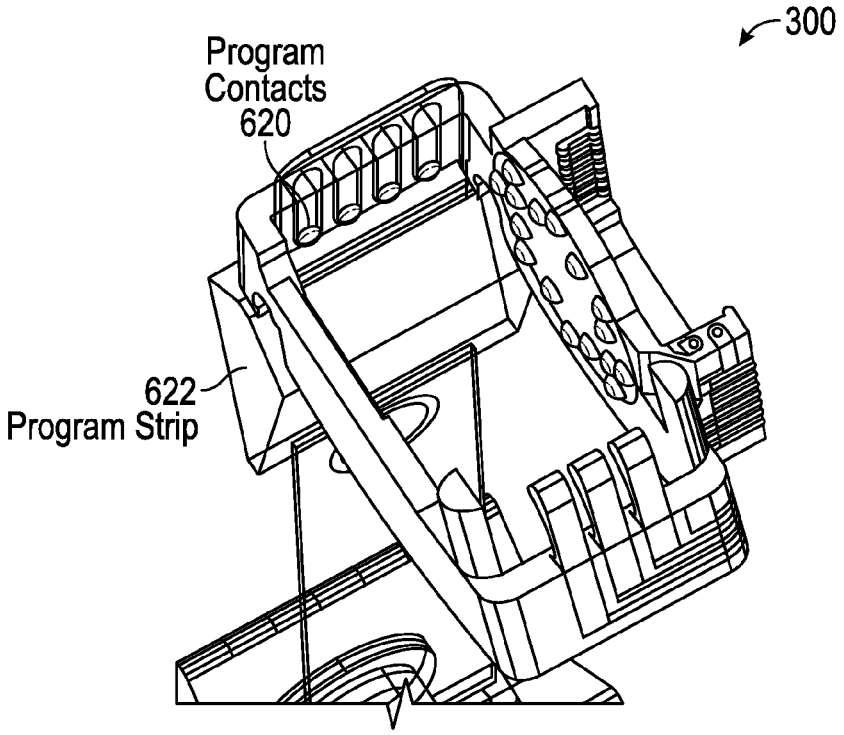
FIGS. 6-7 illustrate views of a MID housing including programming connections for a hearing assistance device, according to various embodiments of the present subject matter.
Figure 7:
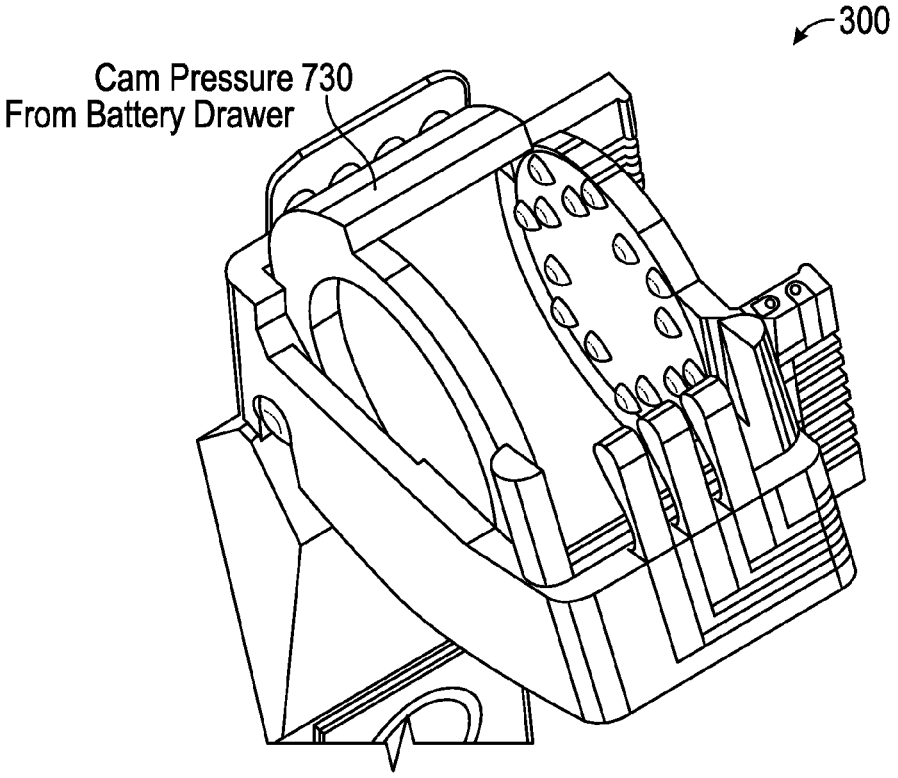

FIGS. 6-7 illustrate views of a MID housing including programming connections for a hearing assistance device, according to various embodiments of the present subject matter. In various embodiments, program connections are made using LDS or other 3D MID technologies to create metallized connection contacts 620 that can also function as interconnects to other components. The MID housing accepts a programming strip 622, in an embodiment. The connection contacts 620 are integral to the MID housing 300, in various embodiments. A battery drawer 730 has cam action that provides compression to ensure a proper connection, according to various embodiments. In conjunction with a stereolithography (SLA) shell with module retention features, any component can be replaced and sent to a central reprocessing point for recovery and possible reuse, all without component or shell damage.

Figure 8:
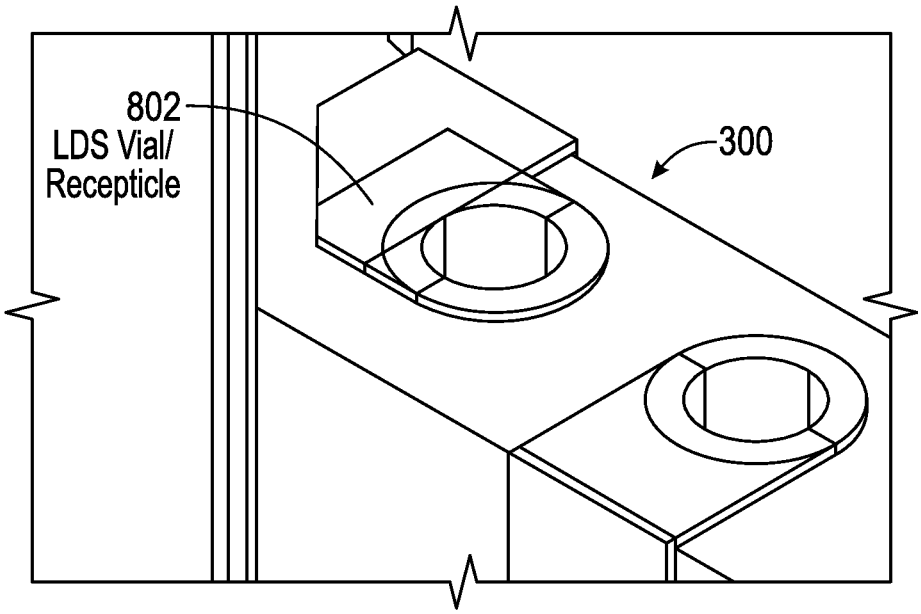
FIGS. 8-10 illustrate views of a MID housing including receiver connections for a hearing assistance device, according to various embodiments of the present subject matter.
Figure 9:
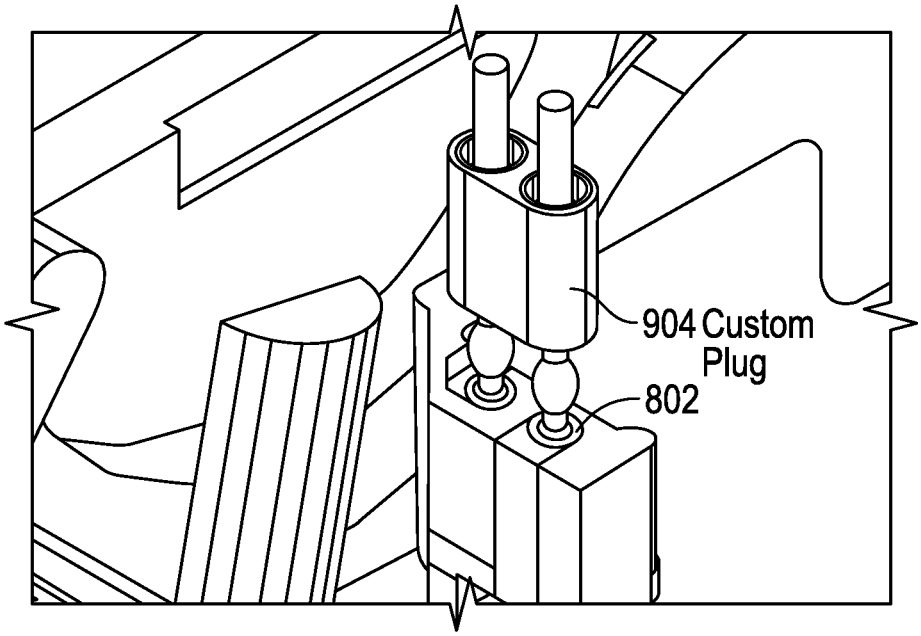
Figure 10:
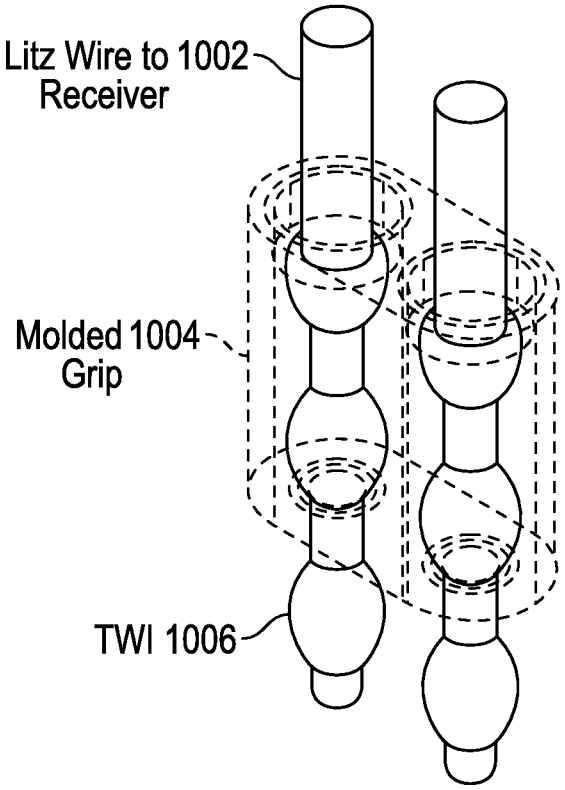

FIGS. 8-10 illustrate views of a MID housing 300 including receiver connections for a hearing assistance device, according to various embodiments of the present subject matter. To acoustically isolate a microphone and a receiver, no rigid connections are made to the receiver, in various embodiments. Flexible wires can be used and twisted to afford electromagnetic interference (EMI) protection as well, in various embodiments. According to various embodiments, LDS is used to provide a receptacle (via) 802. In various embodiments, the receptacle 802 is lasered at the same time as a traces pattern. In one embodiment, the receptacle 802 and custom plug 904 are smaller than currently available receiver connections. In order to provide compression in the connection, twisted wire interconnect (TWI) pins 1006 are used with a custom mold to create a jack/connector, in various embodiments. The TWI plug includes wires 1002 to the receiver and a molded grip 1004, in various embodiments. Other direct insertion mechanisms are possible without departing from the scope of the present subject matter.

The present subject matter can be used for standard fit as well as custom hearing aids, in various embodiments. Modules can be used in place of or in combination with flexible circuits, according to various embodiments. Benefits of the present subject matter include substantial assembly time and cost savings. Furthermore, the use of a common flexible circuit board for a variety of spine designs leads to less design time required for each hearing aid circuit style. The elimination of soldered wires as well as flexible circuit limbs leads to smaller hearing aids, in various embodiments.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, a separate analog and separate digital chip, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), completely-in-the-canal (CIC) or invisible-in-canal (IIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

In addition, the present subject matter can be used in other settings in addition to hearing assistance. Examples include, but are not limited to, telephone applications where noise-corrupted speech is introduced, and streaming audio for ear pieces or headphones.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of manufacturing a hearing assistance device, the method comprising:

providing a molded interconnect device (MID) housing using laser-direct structuring (LDS), wherein the MID housing includes a thermoplastic shell including plastic fingers with integrated circuit traces configured to receive a flexible circuit module;

inserting the flexible circuit module having conductive surface traces into the MID housing, the flexible circuit module configured for a replaceable connection and including electronics for hearing assistance; and connecting the flexible circuit module to the MID housing using direct compression of the integrated circuit traces to the conductive circuit traces without the use of wires or solder; and wherein using a retention band includes using a heat shrink band of irradiated polymer to secure the flexible circuit module to the plastic fingers, and heat is applied to provide compression.

2. The method of claim 1, wherein connecting the flexible circuit module includes connecting a processing module.

3. The method of claim 2, wherein the processing module includes an integrated flex connection on an edge of the processing module, the integrated flex connection including exposed traces.

4. The method of claim 1, wherein connecting flexible circuit module includes connecting a microphone module.

5. The method of claim 4, wherein a microphone enclosure is configured to provide compression for the connection.

6. The method of claim 1, wherein using the retention band includes using a metal clip.

7. The method of claim 1, wherein connecting the flexible circuit module includes making a program connection using cam pressure from a battery drawer.

8. The method of claim 7, wherein the flexible circuit module includes a microphone, and wherein the microphone is replaceable via the battery door.

9. The method of claim 1, wherein providing the molded interconnect device (MID) housing includes providing a laser-direct structuring (LDS) housing.

10. The method of claim 1, wherein connecting the flexible circuit module includes connecting a receiver module using the MID receptacle connection.

11. A hearing assistance device, comprising a molded interconnect device (MID) housing including laser-direct structuring (LDS), wherein the MID housing includes a thermoplastic shell including plastic fingers with integrated circuit traces; and a flexible circuit module having conductive surface traces, the flexible circuit module configured to be replaceably inserted into the MID housing, wherein the flexible circuit module is configured to connect to the MID housing using direct compression of the integrated circuit traces to the conductive surface traces and using a retention band includes using a heat shrink band of irradiated polymer to secure the flexible circuit module to the plastic fingers, and heat is applied to provide compression without the use of wires or solder; and wherein the flexible circuit module includes electronics for hearing assistance.

12. The device of claim 11, wherein the hearing assistance device includes a hearing aid.

13. The device of claim 12, wherein the hearing aid includes an in-the-ear (ITE) hearing aid.

14. The device of claim 12, wherein the hearing aid includes a behind-the-ear (BTE) hearing aid.

15. The device of claim 12, wherein the hearing aid includes an in-the-canal (ITC) hearing aid.

16. The device of claim 12, wherein the hearing aid includes a receiver-in-canal (RIC) hearing aid.

17. The device of claim 12, wherein the hearing aid includes a completely-in-the-canal (CIC) hearing aid.

18. The device of claim 12, wherein the hearing aid includes a receiver-in-the-ear (RITE) hearing aid.

19. The device of claim 12, wherein the hearing aid includes an invisible-in-canal (IIC) hearing aid.

20. The device of claim 11, wherein the molded interconnect device (MID) housing includes a laser-direct structuring (LDS) housing.

* * * * *